United States Patent [19]

Wilkinson

[11] Patent Number: 4,505,477

[45] Date of Patent: Mar. 19, 1985

[54] BALANCING BOARD

[76] Inventor: John M. Wilkinson, 43 Morts Rd., Mortdale, New South Wales, Australia, 2223

[21] Appl. No.: 511,437

[22] Filed: Jul. 7, 1983

[30] Foreign Application Priority Data

Jul. 9, 1982 [AU] Australia ..... PF4790
Feb. 7, 1983 [AU] Australia ..... PF7916

[51] Int. Cl.[3] ..... A63B 23/04
[52] U.S. Cl. ..... 272/146; 280/87.04 R
[58] Field of Search ..... 272/146, 114; 280/87.04 R, 87.04 A

[56] References Cited

U.S. PATENT DOCUMENTS 2,764,411 9/1956 Washburn ..... 272/146
2,829,891 4/1958 Ludwig ..... 272/146
2,829,892 4/1958 Ludwig ..... 272/146
3,023,022 2/1962 Boyden ..... 280/87.04 A
3,630,540 12/1971 Smith ..... 272/146

*Primary Examiner*—Richard J. Johnson
*Attorney, Agent, or Firm*—Townsend and Townsend

[57] ABSTRACT

A balancing board includes a platform to which a pair of parallel tracks are mounted to the lower surface. The tracks each include two parallel rods mounted so that they rotate freely about their axes. A set of wheels are mounted to a common shaft. The wheels are separated so that they roll along the tracks and between the pairs of rods. The wheels are biased toward the center of the tracks by springs or by ramps, or both. Two biasing springs, positioned on either side of the shaft and connected between the shaft and the platform, can be used. Biasing ramps at the far ends of the tracks can be used to bias or redirect the wheels toward the center of the tracks. A depression at the center of each track acts as a detent to tend to center the wheel assembly during use.

5 Claims, 4 Drawing Figures

BALANCING BOARD

The present invention relates to a balancing board.

THE PRIOR ART

It is known in the circus and other such places of entertainment for performancers to balance on boards placed across the rolling surfaces of cylinders. This feat of balancing requires much practice and as such is not suited as a general form of exercise nor for the general public's own form of enjoyment.

OBJECT OF THE INVENTION

The present invention therefore seeks to ameliorate these disadvantages by providing a balancing board which, as it is balanced across a pair of wheels, is easier to master than the existing balancing/cylinder devices and hence becomes a fun device which is useable by the non-invalided members of the general public.

SUMMARY OF THE INVENTION

In one broad form the present invention comprises a balancing board: comprising a substantially planar member or platform upon which the user stands on a first surface thereof; a set of tracks located on the opposed surface of the substantially planar member; a set of wheels adapted to run along said tracks; and one or more biasing members adapted to be connected to the shaft of said wheels to urge said wheels to return to a position substantially midway along the length of the board, and hence to lessen the movement between the planar member and the wheels.

In another broad form the present invention comprises a balancing board: comprising a substantially planar member or platform upon which the user stands on a first surface thereof; a set of tracks located on the opposed surface of the substantially planar member; a set of wheels adapted to run along said tracks; and a one or more biasing members adapted to engage said wheels to urge said wheels to return to a position substantially midway along the length of the board.

BRIEF DESCRIPTION OF THE DRAWINGS

The invention will now be described by way of example with reference to the accompanying drawings in which.

DESCRIPTION OF THE PREFERRED EMBODIMENTS

Figure 1:
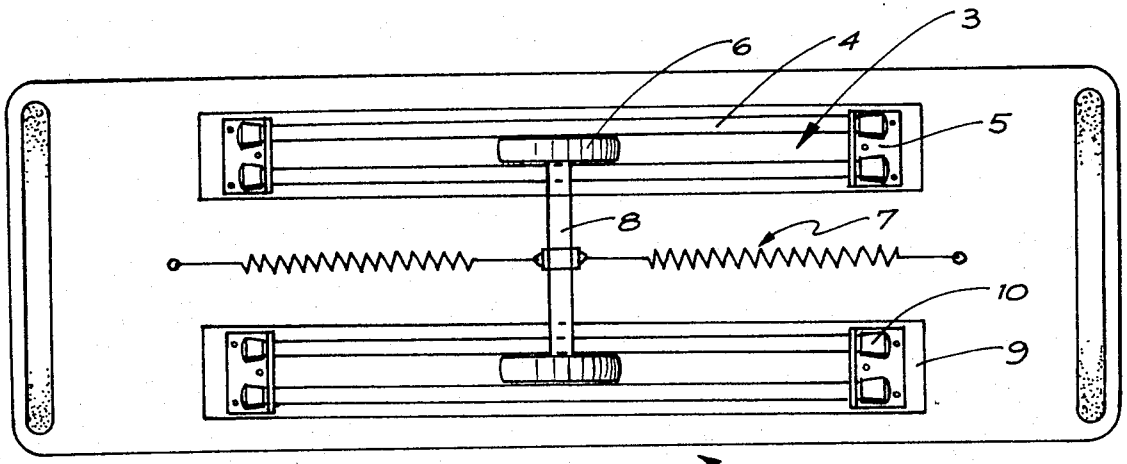
FIG. 1 illustrates a bottom view of one embodiment of the present invention.
Figure 2:
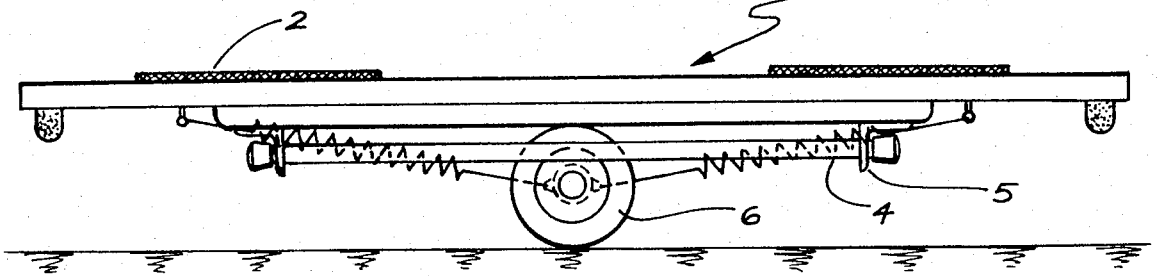
FIG. 2 illustrates a side view of the embodiment of FIG. 1.

As shown in FIGS. 1 and 2 of the accompanying drawings an embodiment of the present invention comprises a planar member or platform 1 which has two pads 2 on the upper surface thereof for the user to stand upon. Preferably these pads 2 are made of a non-slip material such as nylon fibres.

Mounted on the underside of platform 1 are two sets of tracks 3, which are composed of rods 4 that are free to rotate in their mountings 5. A set of wheels 6 rotatably connected to the shaft 8 are placed within the tracks 3. This limits the movement of the board relative to the wheels to a transverse movement as the axis of the wheels are substantially fixed normal to the longitudinal axis of the board and hence provides a more stable platform than in the circus type balancing boards. As a result of the freely rotatable rods 4 the wheels move freely along the tracks 3 which have a minimum amount of contact friction with the wheels 6 and wheel wear is reduced.

A biasing member comprising two springs 7 and 7' are connected to the shaft 8 of the wheels 6 to resiliently hold the wheels at and bias the wheels to approximately the mid point of the platform.

This biasing means, which can take any desired form such as rubber straps, increases the response time for movement of the board relative to the wheels by means of a reaction of the spring to sideways movement of the board so that the stability of the platform is improved over the circus type balancing boards while still providing for a degree of skill to balance properly on the boards. Further the springs ensure that the wheels remain within the track.

Stop members may be positioned on the ends of the bottom of the platform to limit rotational movement of the platform about the wheels.

In use the user stands with feet apart upon the pads of the platform, and once having achieved a point of balance may then with muscular co-ordination move the platform to and fro in a sideways direction.

The platform may be produced from timber, plastic, metal or other suitable materials and preferably the wheels are of 100 mm diameter.

Figure 3:
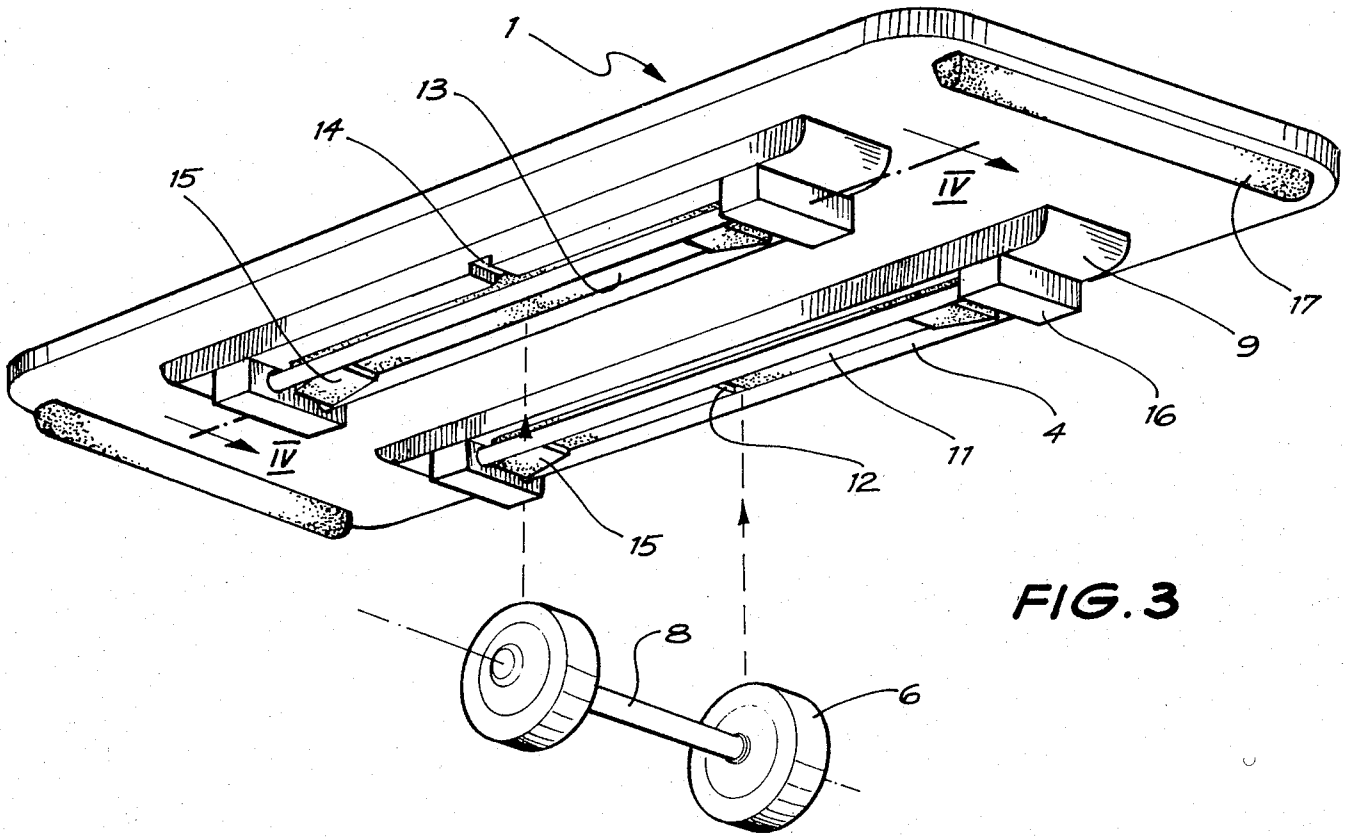
FIG. 3 illustrates another embodiment of the present invention.
Figure 4:
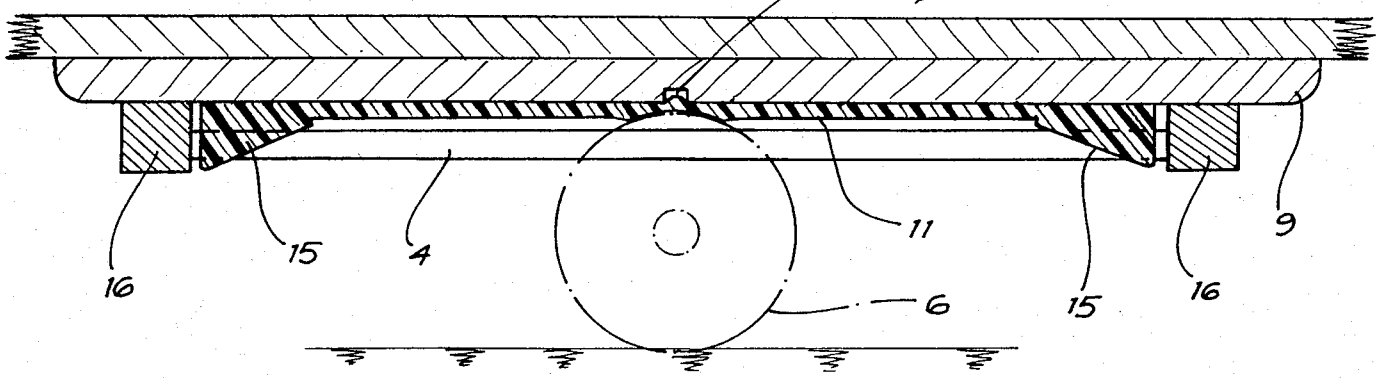
FIG. 4 is a sectional view 1 of the embodiment illustrated in FIG. 3 taken in the direction of the arrows.

As shown in FIGS. 3 and 4 of the accompanying drawing an embodiment of the present invention comprises a planar member or platform 1 which has two pads (not shown) on the upper surface thereof for the user to stand upon. Preferably these pads are made of a non-slip material such as nylon fibres.

Mounted on the underside of platform 1 are two sets of tracks 3 which are composed of rods 4 that are free to rotate in their mountings 16. A set of wheels 6 rotatably connected to the shaft 8 are placed with the tracks 3. This limits the movement of the board relative to the wheels to a transverse movement as the axis of the wheels are substantially fixed normal to the longitudinal axis of the board and hence provides a more stable platform than in the circus type balancing boards. The rods 4 and the wheels 6 are preferably made of polyurethane so as to reduce the friction therebetween. As a result of this the wheels move freely along tracks 3 with a minimum amount of contact friction therewith and the wheel wear is reduced.

A biasing means in the form of ramps 15 are located at each end of the tracks 3. In use these ramps urge the wheels 6 back towards the centre of the board.

As shown in FIG. 3 the rods 4 are rotatably held in blocks 16 which are mounted on support members 9. A resilient plastics or rubber material forms the member 13 which has located on each end integral ramps 15. A step is provided between the ramps 15 and the flat running surface 11 of the member 13 so as to reduce the relative momentum of the wheels 6 as they approach the ramp 15. As shown in the left support member 9 in FIG. 3 and the support in FIG. 4 there is located a transverse slot 14 in the support 9 at the centre of the running surface 11. Thus the running surface 11 is forced into the slot 14 by the wheel 6 as shown in FIG. 4 to provide a position for the wheels to tend to centre.

As shown on the right support 9 in FIG. 3 the support 9 could be unslotted and a transverse slot 12 be formed in the centre of the running surface 11.

Thus the biasing means increases the response time for movement of the board relative to the wheels when the wheels approach the ends of the tracks and also decreases the lateral movement of the board so that the stability of the platform is improved over the circus type balancing boards.

It should be obvious that alterations could be made to the balancing boards described above with departing from the spirit and the scope of the present invention.

I claim:

1. A balancing board comprising:

a substantially planar member having upper and lower surfaces, the user standing on said upper surface;

a set of tracks located on the lower surface of the substantially planar member, each said track comprising two rods rotatably mounted to the lower surface of said planar member at a distance away from said lower surface, each said track including a wheel-engaging running surface;

a set of wheels adapted to run along said running surfaces and between said two rods; and means for biasing said set of wheels towards a central position substantially midway along the length of the planar member.

2. The balancing board of claim 1 wherein:

said set of wheels includes two wheels and a center shaft coupling one said wheel at each shaft end; and said biasing means includes first and second springs having inner and outer ends, said inner ends connected to said shaft and said outer ends mounted to said lower surface on either side of said shaft.

3. The balancing board of claim 1 wherein said biasing means comprises a ramp located at each end of said running surfaces sloped to urge said set of wheels towards said central position.

4. The balancing board of claim 3 wherein said ramps and running surfaces are integrally formed of a resilient material with a step located between the running surfaces and associated ramps.

5. The balancing board of claim 1, 2, 3 or 4 further comprising a slot at said central position of each of the running surfaces which tends to center said set of wheels when said board is in use.

* * * * *